US011161008B1

(12) United States Patent
Sun

(10) Patent No.: US 11,161,008 B1
(45) Date of Patent: Nov. 2, 2021

(54) WRIST TRAINING DEVICE

(71) Applicant: JINAN RUNWE HEALTH TECHNOLOGY CO., LTD, Jinan (CN)

(72) Inventor: Weiye Sun, Jinan (CN)

(73) Assignee: JINAN RUNWE HEALTH TECHNOLOGY CO., LTD, Jinan (CN)

( * ) Notice: Subject to any disclaimer, the term of this patent is extended or adjusted under 35 U.S.C. 154(b) by 0 days.

(21) Appl. No.: 17/322,941

(22) Filed: May 18, 2021

(30) Foreign Application Priority Data

Sep. 17, 2020 (CN) ..... 202010983058.8

(51) Int. Cl.
*A63B 23/14* (2006.01)
*A63B 21/06* (2006.01)
*A63B 21/00* (2006.01)
*A63B 23/035* (2006.01)

(52) U.S. Cl.
CPC ..... *A63B 23/14* (2013.01); *A63B 21/0608* (2013.01); *A63B 21/4035* (2015.10); *A63B 23/03508* (2013.01); *A63B 2225/09* (2013.01)

(58) Field of Classification Search
CPC . A63B 23/14; A63B 21/4035; A63B 21/0608; A63B 23/03508; A63B 2225/09
See application file for complete search history.

(56) References Cited

U.S. PATENT DOCUMENTS 1,013,782 A * 1/1912 Koch ..... A63B 21/4035 482/108
3,363,623 A * 1/1968 Atwell ..... A61H 23/0263 601/72
5,868,653 A * 2/1999 Klasen ..... A61H 23/0263 482/110
7,841,972 B1 * 11/2010 Huang ..... A63B 21/00196 482/108
9,408,774 B2 * 8/2016 Rafaeli ..... A63B 21/06
2007/0298941 A1 * 12/2007 Egger ..... A63B 21/06 482/108
2012/0196729 A1 * 8/2012 Rafaeli ..... A63B 21/00196 482/110
2012/0225758 A1 * 9/2012 Shaw ..... A63B 21/0004 482/110

* cited by examiner

*Primary Examiner* — Andrew S Lo

(57) ABSTRACT

The present disclosure provides a wrist training device. The wrist training device includes a handle, a central shaft, an adjusting device, and two counterweight wheels. The handle is sleeved on the central shaft. The central shaft includes a thick end and a thin end. One of the two counterweight wheels is fixedly connected to the thick end of the central shaft. Another one of the two counterweight wheels is rotatably connected to the thin end of the central shaft. A hollow groove is arranged on an end surface of the thin end of the central shaft. A plurality of limiting grooves are disposed on a circumferential surface of the thin end of the central shaft. Each counterweight wheels is of an eccentric structure. The adjusting device is arranged on the thin end of the central shaft and arranged in the other counterweight wheel.

6 Claims, 3 Drawing Sheets

WRIST TRAINING DEVICE

TECHNICAL FIELD

The present disclosure relates to a field of sports equipment technology, and in particular to a wrist training device.

BACKGROUND

In sports training or in an exercise process, the wrist is a very important portion to be trained. Strength of the wrist plays a vital role in maintaining daily exercise. However, the wrist is the most vulnerable portion. Therefore, it is necessary to strengthen training of wrist strength. There is a variety of methods for wrist strength training. Conventional sport equipment on the market is used to enhance strength of the wrist muscles, where most of them have defects of insufficient exercise strength, poor professionalism, and poor flexibility in use.

SUMMARY

An object of the present disclosure is to provide a wrist training device to solve problems mentioned above.

In order to achieve above objectives, the present disclosure provides following technical solutions. The present disclosure provides a wrist training device. The wrist training device comprises a handle, a central shaft, an adjusting device, and two counterweight wheels.

The handle is sleeved on the central shaft. The central shaft comprises a thick end and a thin end. One of the two counterweight wheels is fixedly connected to the thick end of the central shaft. The other one of the two counterweight wheels is rotatably connected to the thin end of the central shaft. A hollow groove is arranged on an end surface of the thin end of the central shaft. A plurality of limiting grooves are disposed on a circumferential surface of the thin end of the central shaft. Each counterweight wheel is of an eccentric structure.

The adjusting device is arranged on the thin end of the central shaft and arranged in the other counterweight wheel arranged on the thin end of the central shaft 4. The adjusting device comprises a retaining ring and a spring support, a spring, a limiting buckle, and a button. The retaining ring is sleeved on the thin end of the central shaft. The limiting buckle comprises a plurality of clamping columns coupled to the plurality of limiting grooves. The spring support is arranged in the hollow groove. One end of the spring is arranged in the spring support. The other end of the spring is arranged on an inner side of the limiting buckle. The other end of the spring is surrounded by the plurality of clamping columns. The button is arranged on an outer side of the limiting buckle.

Furthermore, the number of the plurality of clamping columns is in a range of 2 to 4 columns. The number of the plurality of limiting grooves is 1 to 4 times of the number of the plurality of clamping columns.

Furthermore, two anti-skid blocks are symmetrically arranged on a surface of the handle.

Furthermore, the two anti-skid blocks are made of rubber. Patterns are provided on a surface of each anti-skid block.

Furthermore, the handle includes two ends. Each end of the handle has a bearing symmetrically arranged therein. The two bearings are sleeved on the central shaft.

Furthermore, each counterweight wheel is of an elliptical solid structure and is made of steel material.

In the present disclosure, the centrifugal counterweight wheels are provided. Meanwhile, by adjusting a relative angle between the two counterweight wheels, a user is allowed to train wrist and arm strength in various forms. Thus, the user is able to use great wrist strength during training, which enables a wide range of exercise, high flexibility, and enables wrist strength training professional.

1—counterweight wheel; 2—handle; 3—bearing; 4—central shaft; 5—adjusting device; 6—anti-skid block; 7—limiting groove; 8—hollow groove; 501—retaining ring; 502—spring support; 503—spring; 504—limiting buckle; 505—clamping column; and 506—button.

DETAILED DESCRIPTION

In order to facilitate an understanding of the present disclosure, the present disclosure will be described in a comprehensive manner with reference to the relevant drawings.

Figure 1:
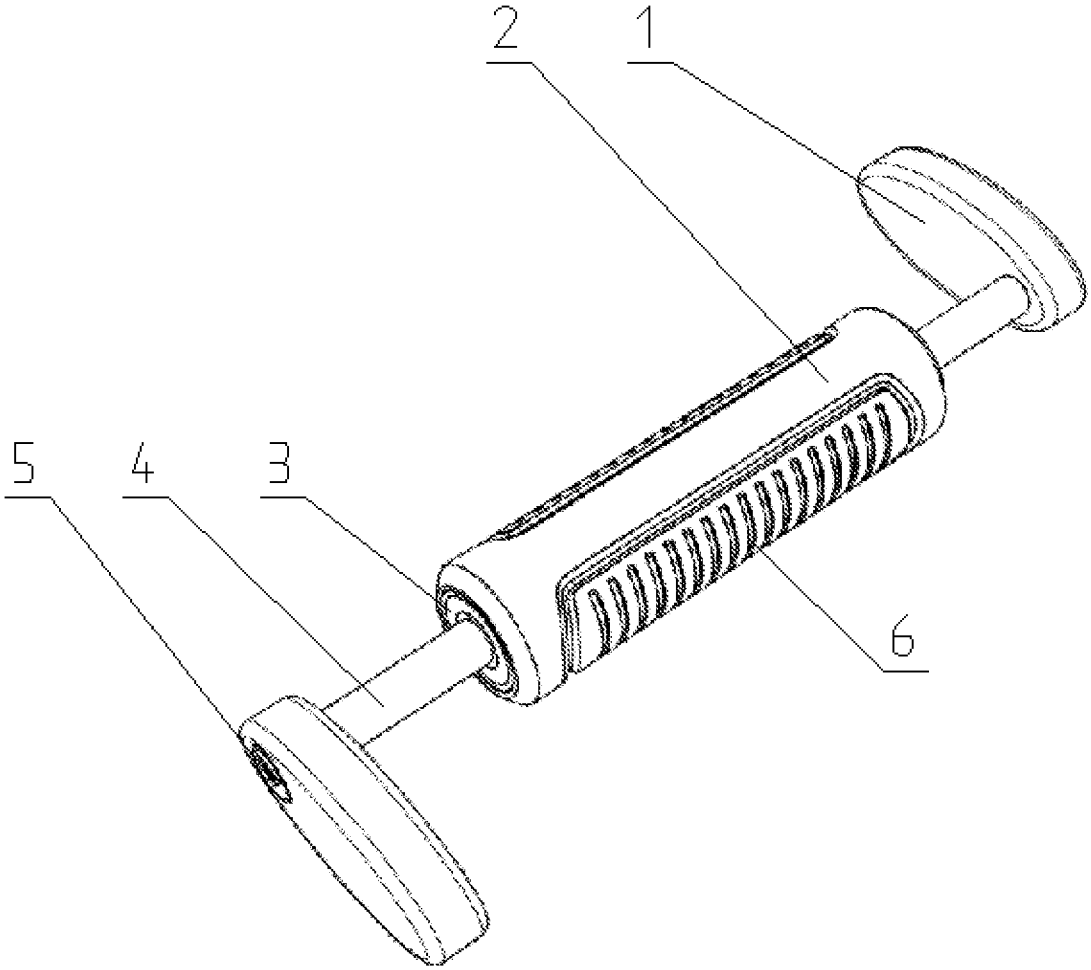
FIG. 1 is a perspective schematic diagram of a wrist training device of the present disclosure.
Figure 2:
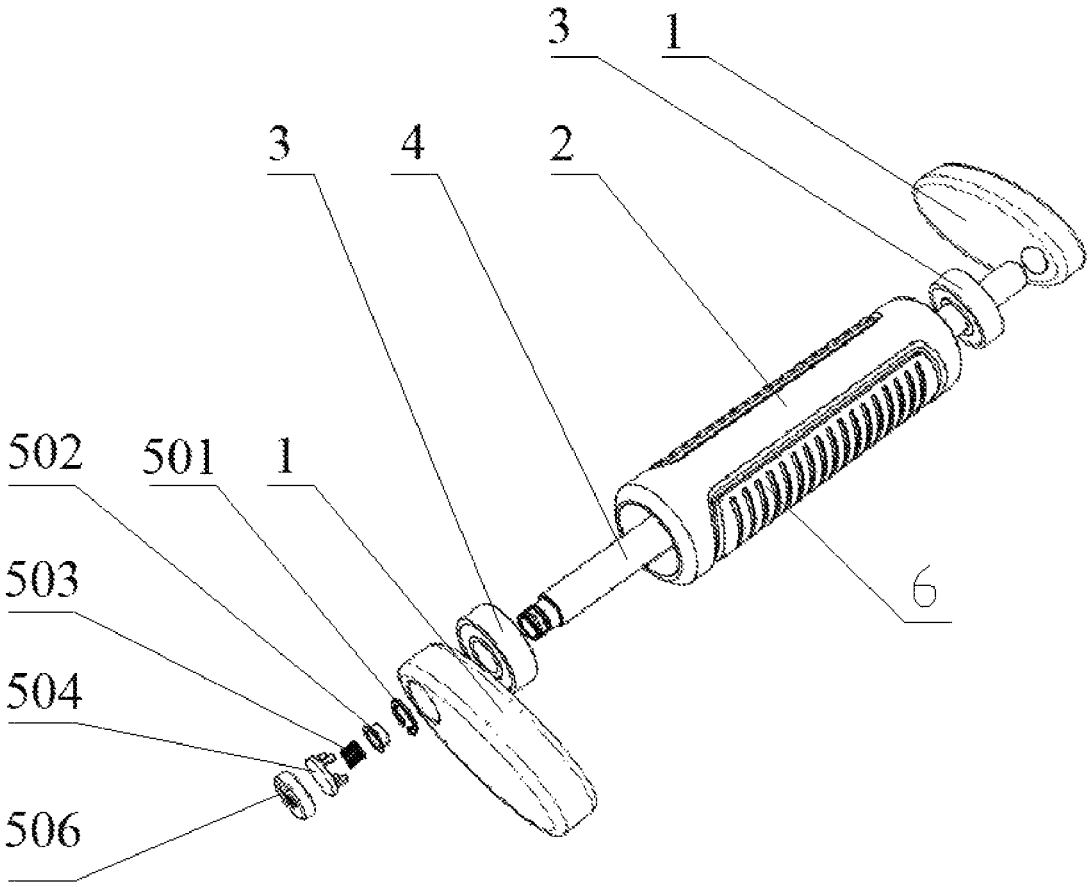
FIG. 2 is an exploded schematic diagram of the wrist training device of the present disclosure.
Figure 3:
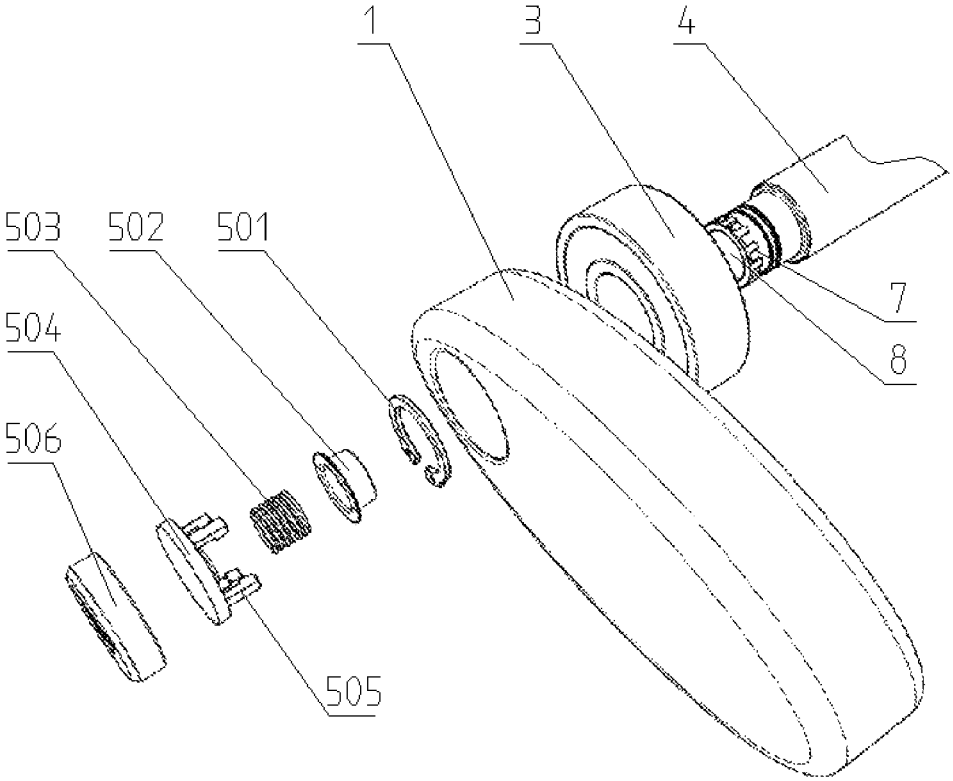
FIG. 3 is an enlarged schematic diagram of an adjusting device of the present disclosure.

As shown in FIGS. 1-3, the present disclosure provides a wrist training device. The wrist training device comprises a handle 2, a central shaft 4, an adjusting device 5, and two counterweight wheels 1. Two anti-skid blocks 6 are symmetrically arranged on a surface of the handle 2. The two anti-skid blocks 6 are made of rubber. Patterns configured for anti-skid are provided on a surface of each anti-skid block 6. The handle 2 includes two ends. Each end of the handle 2 has a bearing 3 symmetrically arranged therein. The central shaft 4 passes the two bearings 3 and is sleeved by the two bearings 3.

The central shaft 4 comprises a thick end and a thin end. One of the two counterweight wheels 1 is fixedly connected to the thick end of the central shaft 4. The other one of the two counterweight wheels 1 is rotatably connected to the thin end of the central shaft 4. The adjusting device 5 is arranged in the other counterweight wheel 1 arranged on the thin end of the central shaft 4. The adjusting device 5 comprises a retaining ring 501, a spring support 502, a spring 503, a limiting buckle 504, and a button 506. The retaining ring 501 is sleeved on the thin end of the central shaft 4. The limiting buckle 504 is integrated with 2-4 clamping columns 505. The spring support 502 is arranged in a hollow groove 8 arranged on an end surface of the thin end of the central shaft 4. One end of the spring 503 is arranged in the spring support 502. The other end of the spring is arranged on an inner side of the limiting buckle. The other end of the spring 503 is arranged in an inner side of the limiting buckle 504 and is surrounded by the clamping columns 505. The button 506 is arranged on an outer side of the limiting buckle 504.

A plurality of limiting grooves 7 are disposed on a circumferential surface of the thin end of the central shaft. The limiting grooves are corresponding to the clamping columns 505. The number of the plurality of limiting grooves 7 is 1 to 4 times of the number of the plurality of clamping columns 505. Each counterweight wheel is of an eccentric structure. Each counterweight wheel is of an elliptical solid structure and is made of steel material.

Embodiment 1

The counterweight wheel 1 arranged on the thin end of the central shaft 4 is fixedly mounted through the adjusting device 5, so that the two counterweight wheels 1 arranged on the two sides of the central shaft 4 are arranged in a 180° reverse arrangement. At this time, training force is the smallest. After the counterweight wheel 1 arranged on the thin end of the central shaft 4 is fixed, an exerciser can hold the handle 2 with his hand, rotate his wrist, and rely on strength of his wrist to drive the two counterweight wheels 1 of the elliptical eccentric structure to rotate around the central shaft 4 to achieve effect of exercising the wrist strength.

Embodiment 2

In order to meet needs of outreach training, a relative angle between the two counterweight wheels 1 on two sides of the central shaft 4 is adjusted. The training force is maximum when the counterweight wheels 1 on two sides of the central shaft 4 are arranged in a same direction and are arranged in parallel.

A rotating angle of the counterweight wheel 1 arranged on the thin end of the central shaft 4 is related to the number of limiting grooves 7.

In the embodiment, e.g., the number of the clamping columns 505 is 4, the number of limiting grooves 7 is twice the number of the clamping columns 505. That is, the number of the limiting grooves 7 is 8.

When adjusting, the button 506 is pressed by fingers of the exerciser to disengage the clamping columns 505 on the limiting buckle 504 from corresponding limiting grooves 7. Meanwhile, the limiting buckle 504 compresses the spring 503 to generate a rebound force. At this time, the exerciser is able to manually rotate the counterweight wheel 1 arranged on the thin end of the central shaft 4. Every time the counterweight wheel 1 arranged on the thin end of the central shaft 4 turns through a limiting groove 7, the rotating angle of is 360 degrees/8=45 degrees. The rotating angle of the counterweight wheel 1 arranged on the thin end of the central shaft 4 is adjusted by rotating through different numbers of the limiting grooves 7.

After the counterweight wheel 1 arranged on the thin end of the central shaft 4 is rotated to a suitable angle according to individual needs of the exerciser, the button 506 is released, the limiting buckle 504 is reset under rebound force of the spring 503, and the clamping columns 505 is re-inserted into the limiting grooves 7 to lock the counterweight wheel 1 arranged on the thin end of the central shaft 4 to complete an adjustment of the rotating angle of the counterweight wheel 1 arranged on the thin end of the central shaft 4.

It is noted that in above two embodiments, different training strengths are obtained according to relative angles between the two counterweight wheels 1 on two sides of the central shaft 4, so as to achieve different exercise effects.

It is particularly noted that, in the present disclosure, the bearings 3, the retaining ring 501, and the spring 503 are common applications in the prior art, which are not limited hereto.

In the description of the present disclosure that terms such as "upper", "lower", "inner", "outer", "center", etc. indicate direction or position relationships shown based on the drawings, and are only intended to facilitate the description of the present disclosure and the simplification of the description rather than to indicate or imply that the indicated device or element must have a specific direction or constructed and operated in a specific direction, and therefore, shall not be understood as a limitation to the present disclosure.

In the present disclosure, it should be noted in the description of the present disclosure that, unless otherwise regulated and defined, terms such as "combined", "set", "connected", "fixed", "tight" shall be understood in broad sense. For example, they may refer to fixed connection, detachable connection, or integral connection; may refer to mechanical connection or electrical connection; and may refer to direct connection or indirect connection through an intermediate medium or inner communication of two elements. For those of ordinary skill in the art, the meanings of the above terms in the present disclosure may be understood according to concrete conditions.

The above are only optional specific embodiments of the present disclosure, but a protection scope of the present disclosure is not limited hereto. Any deductions or substitutions made by those skilled in the art that familiar with the technical field and without departing from technical solution of the present disclosure and the concept of the present disclosure, should all be regarded as falling within the protection scope of the present disclosure.

In addition, it should be understood that although the specification is described in accordance with specific implementation modes, it does not mean that each implementation mode only includes an independent technical solution. The description in the specification is only for clarity. Those skilled in the art should regard the specification as a whole. The technical solutions in the various embodiments can also be appropriately combined to form other implementations that can be understood by those skilled in the art.

What is claimed is:

1. A wrist training device, comprising:

a handle;

a central shaft;

an adjusting device; and two counterweight wheels;

wherein the handle is sleeved on the central shaft; the central shaft comprises a thick end and a thin end; one of the two counterweight wheels is fixedly connected to the thick end of the central shaft; the other one of the two counterweight wheels is rotatably connected to the thin end of the central shaft; a hollow groove is arranged on an end surface of the thin end of the central shaft; a plurality of limiting grooves are disposed on a circumferential surface of the thin end of the central shaft; each counterweight wheel is of an eccentric structure;

wherein the adjusting device is arranged on the thin end of the central shaft and arranged in the other counterweight wheel arranged on the thin end of the central shaft; the adjusting device comprises a retaining ring, a spring support, a spring, a limiting buckle, and a button; the retaining ring is sleeved on the thin end of the central shaft; the limiting buckle comprises a plurality of clamping columns coupled to the plurality of the limiting grooves; the spring support is arranged in the hollow groove; one end of the spring is arranged in the spring support; another end of the spring is arranged on an inner side of the limiting buckle; the another end of the spring is surrounded by the plurality of the clamping columns; the button is arranged on an outer side of the limiting buckle.

2. The wrist training device according to claim 1, wherein a number of the plurality of clamping columns is in a range of 2 to 4 columns; a number of the plurality of limiting grooves is 1 to 4 times of the number of the plurality of clamping columns.

3. The wrist training device according to claim 1, wherein two anti-skid blocks are symmetrically arranged on a surface of the handle.

4. The wrist training device according to claim 3, wherein the two anti-skid blocks are made of rubber; patterns are provided on a surface of each anti-skid block.

5. The wrist training device according to claim 4, wherein the handle includes two ends, each end of the handle having a bearing symmetrically arranged therein; the bearings being sleeved on the central shaft.

6. The wrist training device according to claim 5, wherein each counterweight wheel is of an elliptical solid structure and is made of steel material.

* * * * *